US006421516B1

(12) United States Patent
Kinoshita et al.

(10) Patent No.: US 6,421,516 B1
(45) Date of Patent: Jul. 16, 2002

(54) DEVELOPING DEVICE AND IMAGE FORMING APPARATUS HAVING A RESTRICTED DEVELOPER SURFACE LEVEL FEATURE

(75) Inventors: Masahide Kinoshita; Seiji Yamaguchi; Motoki Adachi, all of Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/664,072

(22) Filed: Sep. 18, 2000

(30) Foreign Application Priority Data

Sep. 20, 1999 (JP) ..... 11-266378

(51) Int. Cl.[7] ..... G03G 15/08
(52) U.S. Cl. ..... 399/254; 399/255; 399/256
(58) Field of Search ..... 399/254, 255, 399/256, 258–260, 27, 30, 61–63

(56) References Cited

U.S. PATENT DOCUMENTS

| | | | | |
|---|---|---|---|---|
| 4,873,551 | A | | 10/1989 | Tajima et al. |
| 4,887,131 | A | | 12/1989 | Kinoshita et al. |
| 5,086,728 | A | | 2/1992 | Kinoshita |
| 5,287,150 | A | | 2/1994 | Kinoshita et al. |
| 5,311,264 | A | | 5/1994 | Kinoshita |
| 5,572,299 | A | * | 11/1996 | Kato et al. ..... 399/256 |
| 5,893,013 | A | | 4/1999 | Kinoshita et al. ..... 399/284 |
| 5,895,151 | A | | 4/1999 | Kinoshita et al. ..... 399/284 |
| 6,026,265 | A | | 2/2000 | Kinoshita et al. ..... 399/281 |
| 6,058,284 | A | | 5/2000 | Okano et al. ..... 399/284 |
| 6,115,575 | A | | 9/2000 | Kinoshita et al. ..... 399/286 |

* cited by examiner

*Primary Examiner*—William J. Royer
(74) *Attorney, Agent, or Firm*—Fitzpatrick, Cella, Harper & Scinto

(57) ABSTRACT

A developing device and an image forming apparatus includes a developer container for containing a developer made up of magnetic particles and a toner; a developer carrier for bearing and transporting the developer; a first agitating and transporting unit provided in the developer container, the first agitating and transporting unit transporting the developer while agitating the developer; a second agitating and transporting unit provided in the developer container, the second agitating and transporting unit transporting the developer transported by the first agitating and transporting unit while agitating the developer, thereby supplying the developer to the developer carrier; and a restricting member provided in the developer container, the restricting member restricting passage of an upper portion of the developer transported by the first agitating and transporting unit, thereby achieving a desired developer surface level.

37 Claims, 9 Drawing Sheets

DEVELOPING DEVICE AND IMAGE FORMING APPARATUS HAVING A RESTRICTED DEVELOPER SURFACE LEVEL FEATURE

BACKGROUND OF THE INVENTION

1. Field of the Invention

The present invention relates to a developing device and an image forming apparatus in which an electrostatic latent image is formed on an image carrier with a electrophotographic process or an electrostatic recording process, for example, and then developed using a two-component developer. Further, the present invention relates to a process cartridge and an electrophotographic image forming apparatus to which the process cartridge is mounted in a detachable manner.

Herein, the terms "image forming apparatus" and "electrophotographic image forming apparatus" include, for example, copying machines, printers (such as an LED printer and a laser beam printer), facsimiles, word processors, etc.

Also, the term "process cartridge" implies not only an integral unit comprising at least one of a charging means, developing means, and cleaning means, and an electrophotographic photoconductor, which are constructed in the form of a cartridge, the cartridge being detachably mounted to a body of an electrophotographic image forming apparatus, but also implies an integral unit comprising at least a developing means and an electrophotographic photoconductor which are constructed in the form of a cartridge, the cartridge being detachably mounted to the body of the electrophotographic image forming apparatus.

2. Description of the Related Art

Hitherto, the so-called two-component developing method has been employed in many apparatuses. The two-component developing method utilizes a two-component developer, which is made up of a nonmagnetic toner (hereinafter referred to simply as a "toner") and a magnetic carrier (hereinafter referred to simply as a "carrier"), as a developer to visualize an electrostatic latent image formed on an image carrier.

According to the two-component developing method, a two-component developer is agitated by a developer agitating and transporting means (hereinafter referred to simply as an "agitating means") disposed in a developer container for containing the developer, so that the toner is electrically charged as a result of friction. Thereafter, the developer is transported to a developing sleeve that serves as a developer carrier and includes a stationary magnet roller disposed therein. Then, the developer is borne on the surface of the developing sleeve and transported with the rotation of the developing sleeve. The developer is thereby supplied to an electrostatic latent image formed on an image carrier for developing the latent image.

A two-component developing device employing the two-component developing method is advantageous in that it has a longer useful life and a lower operating cost because the device can be used repeatedly by replenishing only the toner from a toner resupply unit provided separately. Accordingly the two-component developing device has been widely used.

A process cartridge scheme is also known in which an electrophotographic photoconductor and at least one process means acting on the electrophotographic photoconductor are constructed into an integral unit in the form of a cartridge, and the cartridge is detachably mounted to a body of an image forming apparatus. This process cartridge scheme enables a user to carry out maintenance of the apparatus without the need for a serviceman, and hence can achieve a noticeable improvement in operability. For that reason, this process cartridge scheme has been widely used in electrophotographic image forming apparatuses.

FIG. 7 schematically shows a cross-section of a typical conventional two-component developing device. A developer container 50 for accommodating a two-component developer includes, as a developer carrier, a developing sleeve 51 rotatable in the direction of arrow "y". The developing sleeve 51 is a hollow metallic sleeve including a magnet roller 52 disposed therein, which serves as a magnetic field generating means. As shown in FIG. 7, a doctor blade 53 serving as a developer layer thickness restricting means is provided closely below the developing sleeve 51. As the developing sleeve 51 rotates in the direction of arrow "y", the developer transported to a gap between the developing sleeve 51 and the doctor blade 53 is formed into a thin layer by the doctor blade 53.

In the developer container 50, an A screw 54 is disposed as a first agitating means to extend substantially parallel with the longitudinal direction of the developing sleeve 51. As the A screw rotates in the direction of the arrow "x" in FIG. 7, it transports and agitates the developer. On the opposite side of the developing sleeve 51 to the A screw 54, a B screw 55 is disposed as a second agitating means rotatably in the direction of arrow "z" in FIG. 7.

Also, a toner density sensor 56 serving as a developer amount detecting means is provided on a wall surface of the developer container 50 which faces the B screw 55 on the side opposite to the A screw 54. A sensor surface 56*a* of the toner density sensor 56 is positioned near the B screw 55 and arranged to lie perpendicularly to a line connecting a rotary shaft of the B screw 55 and the toner density sensor 56. The reason why the sensor surface 56*a* is so arranged with respect to the B screw 55 is for preventing buildup of the developer on the sensor surface 56*a*. If the toner is built up on the sensor surface 56*a*, the toner density sensor 56 will fail to precisely detect a toner density (i.e., a mixing ratio of the carrier and the toner) in the developer.

FIG. 8 schematically shows the construction of the developing device of FIG. 7 as viewed from above. The A screw 54 and the B screw 55 are arranged substantially parallel with each other, and an inner wall 57 is provided between both the screws 54, 55 as a partition to prevent the developer from moving directly from one of both screws 54, 55 to the other. However, the inner wall 57 is not provided in areas corresponding to longitudinal opposite portions of the A screw 54 and the B screw 55, allowing the developer to move between both screws 54, 55. The A screw 54 and the B screw 55 are rotated in the directions of their respective arrows shown in FIG. 7 to transport the developer in the opposite longitudinal directions, i.e., in the directions of respective arrows X and Y shown in FIG. 8. Thus, a circulation path for the developer is formed within the developer container 50 to ensure continuous developer circulation.

The toner density sensor 56 is disposed in the upstream side of the B screw 55 in the direction of transport of the developer. The reason for arranging the toner density sensor 56 in the upstream side of the B screw 55 in the direction of transport of the developer is for enabling toner density detection to be immediately made on the developer that has been subjected to image formation using the toner and has a reduced toner density. More specifically, the developer residing in the A screw 54 side (hereinafter referred to as a "development chamber 50A") of the developer container 50 partitioned by the inner wall 57 is borne by the developer carrier and employed for image formation. Thereafter, the developer is sent to the B screw 55 side (hereinafter referred to as an "agitation chamber 50B") of the developer container 50 partitioned by the inner wall 57 following the above-described circulation path, and the toner density is immediately detected by the toner density sensor 5. In accordance with a detected result, an appropriate amount of the developer is replenished from a toner resupply unit 59 (FIG. 7), which is provided adjacent to the developer container 50 and communicated with it, through a toner resupply port 58 positioned downstream of the toner density sensor 56 in the direction of transport of the developer. Consequently, the toner density of the developer is kept constant.

As seen from the above, the circulation of the developer is particularly important in the two-component developing device.

The above-described conventional developing device, however, has a problem that it is sometimes difficult to circulate the developer in a satisfactory manner depending on long-duration operation and environmental conditions.

Stated otherwise, the following points must be taken into consideration to realize satisfactory circulation of the developer in the two-component developing device.

First, the position of an upper surface of the developer (hereinafter referred to as a "developer surface") contained in the A screw 54 side, i.e., in the development chamber 50A, is preferably high to some extent. If the developer surface is lowered down beyond a certain level, the total amount of the developer transported by the a screw 54 would be so small that the amount of the developer supplied to the developing sleeve 51 and retained by the doctor blade 53 is reduced and variations in the supply of the developer from the A screw 54 to the developing sleeve 51 tend to occur in corresponding areas. More specifically, variations in the supply of the developer are likely to occur corresponding to the pitch of a spiral vane 54*a* of the A screw 54, and a coating of the developer formed on the developing sleeve 51 is apt to have thicker and thinner portions at the pitch of the vane 54*a*. This causes the so-called screw pitch unevenness, i.e., unevenness in image density at the screw pitch. For that reason, it is desired that the level of the developer surface in the development chamber 50A be high.

Secondly, the position of an upper surface of the developer (i.e., a developer surface) contained in the B screw 55 side, i.e., in the agitation chamber 50B, is preferably lower than the top of a spiral vane 55*a* of the B screw 55. The reason is that the agitation chamber 50B has a function of agitating the developer, and if the developer surface is too high, there would occur a difficulty in agitating the developer residing at a level higher than the top of the vane 55*a*. Particularly, as shown in FIG. 9, if the toner is replenished under a condition where the level of the developer surface is higher than the top of the vane 55*a*, a newly added toner having a smaller specific gravity than the developer will often remain floating on the developer surface. Such a phenomenon causes problems that the toner is hard to evenly mix with the developer and the toner not yet electrically charged is supplied to the development chamber 50A, thus resulting in fogging or density failure. Where the level of the developer surface in the agitation chamber 50B is lower than the top of the B screw 55, the replenished toner is forced to be taken into the developer with the rotation of the B screw 55 and then sufficiently agitated, thus not giving rise to problems, such as fogging and density failure.

Thirdly, the position of the developer surface in the agitation chamber 50B is preferably higher than the sensor surface 56*a* of the toner density sensor 56. If the sensor surface 56*a* is not covered with the developer, the toner density sensor 56 would generate a noticeably dropped sensor output and detect that the toner density is very small. Even with the developer surface level being lower than the top of the sensor surface 56*a* of the toner density sensor 56, a sensor output value will not vary if the developer surface level is kept constant with stability. In practice, however, the developer surface level varies to some extent. Accordingly, when the sensor surface 56*a* is not completely covered with the developer, variations in sensor output are remarkably increased, thus resulting in an unsatisfactory result. One conceivable method for overcoming the above-described problem is to mount the sensor surface 56*a* at a lower position, but there is actually a restriction in selecting the mount position of the sensor surface 56*a* from the relationship in size between the developer container 50 and the sensor surface 56*a*.

Fourthly, the developer surfaces in the development chamber 50A and the agitation chamber 50B are preferably almost horizontal in each of the development chamber 50A and the agitation chamber 50B. If the developer surface in the development chamber 50A is inclined in the longitudinal direction, the amount of the developer supplied to the developing sleeve 51 would be uneven in the longitudinal direction and a formed image would have a density difference in the corresponding direction. Also, if the developer surface in the agitation chamber 50B is inclined, a charging capability as a result of friction would be deteriorated.

For satisfying the above first to third conditions, it is conceivable to adjust the pitches of the screw vanes 54*a*, 55*a* and the rotational speeds of the A and B screws 54, 55 to relatively increase transport power of the B screw so that the developer surface in the A screw 54 side (the development chamber 50A) is kept higher and the developer surface in the B screw 55 side (the agitation chamber 50B) is kept lower. However, this method will raise the developer surface level in the upstream side of the development chamber 50A in the direction of transport of the developer and lower the developer surface level on the downstream side thereof. Eventually, the method cannot satisfy the above-described fourth condition and gives rise to a density difference in the longitudinal direction.

For satisfying the above-described first to fourth conditions, it is therefore required to optimize the developer surface levels in the development chamber 50A and the agitation chamber 50B while holding the developer surfaces in both chambers at respective levels not much different from each other and maintaining stable circulation of the developer, and to optimize the amount of the developer for realizing the optimum developer surface levels.

However, the bulk density of the two-component developer changes depending on environmental conditions and a long-duration operation, and such a change brings about variations in level of the developer surface in the developer container 50. This phenomenon is presumably attributable to variations in the amount of electricity charged on the toner. It is generally known that the developer surface level is raised in a low humidity environment and lowered in a high humidity environment.

Thus, even when the amount of the developer is held optimum to closely control the developer surface level in the developer container 50, the developer surface level eventually varies for the reasons such as environmental conditions and a long-duration operation. In other words, controlling the developer surface level in a proper range to satisfy the above-mentioned first to fourth conditions has been hitherto impossible to realize in practice.

The present invention has been accomplished in view of the above-described problems in the related art.

SUMMARY OF THE INVENTION

Accordingly, it is an object of the present invention to provide a developing device and an image forming apparatus, which can always produce a high-quality image.

Another object of the present invention is to provide a developing device and an image forming apparatus, which can always produce a high-quality image by holding the position of an upper surface of a developer (i.e., a developer surface), accommodated in a developer container, at an appropriate level to prevent image failures such as unevenness in image density and fogging.

Still another object of the present invention is to provide a developing device and an image forming apparatus, which can maintain the level of the developer surface in a appropriate range to prevent image failures, such as unevenness in image density and fogging, with stability even when the bulk density of the developer in the developer container changes depending on environmental conditions and a long-duration operation, and which can always operate with stable performance.

Still another object of the present invention is to provide a developing device and an image forming apparatus, each of which comprises a developer container for containing a developer made up of a magnetic particle and a toner; a developer carrier for bearing and transporting the developer; a first agitating and transporting unit provided in the developer container, the first agitating and transporting unit transporting the developer while agitating the developer; a second agitating and transporting unit provided in the developer container, the second agitating and transporting unit transporting the developer transported by the first agitating and transporting unit while agitating the developer, thereby supplying the developer to the developer carrier; and a restricting member provided in the developer container, the restricting member restricting passage of an upper portion of the developer transported by the first agitating and transporting unit, thereby maintaining a desired developer surface level.

Further objects, features and advantages of the present invention will become apparent from the following description of the preferred embodiments with reference to the attached drawings.

DESCRIPTION OF THE PREFERRED EMBODIMENTS

A developing device, an image forming apparatus, a process cartridge, and an electrophotographic image forming apparatus will be described below in more detail with reference to the drawings.

First Embodiment

Figure 1:
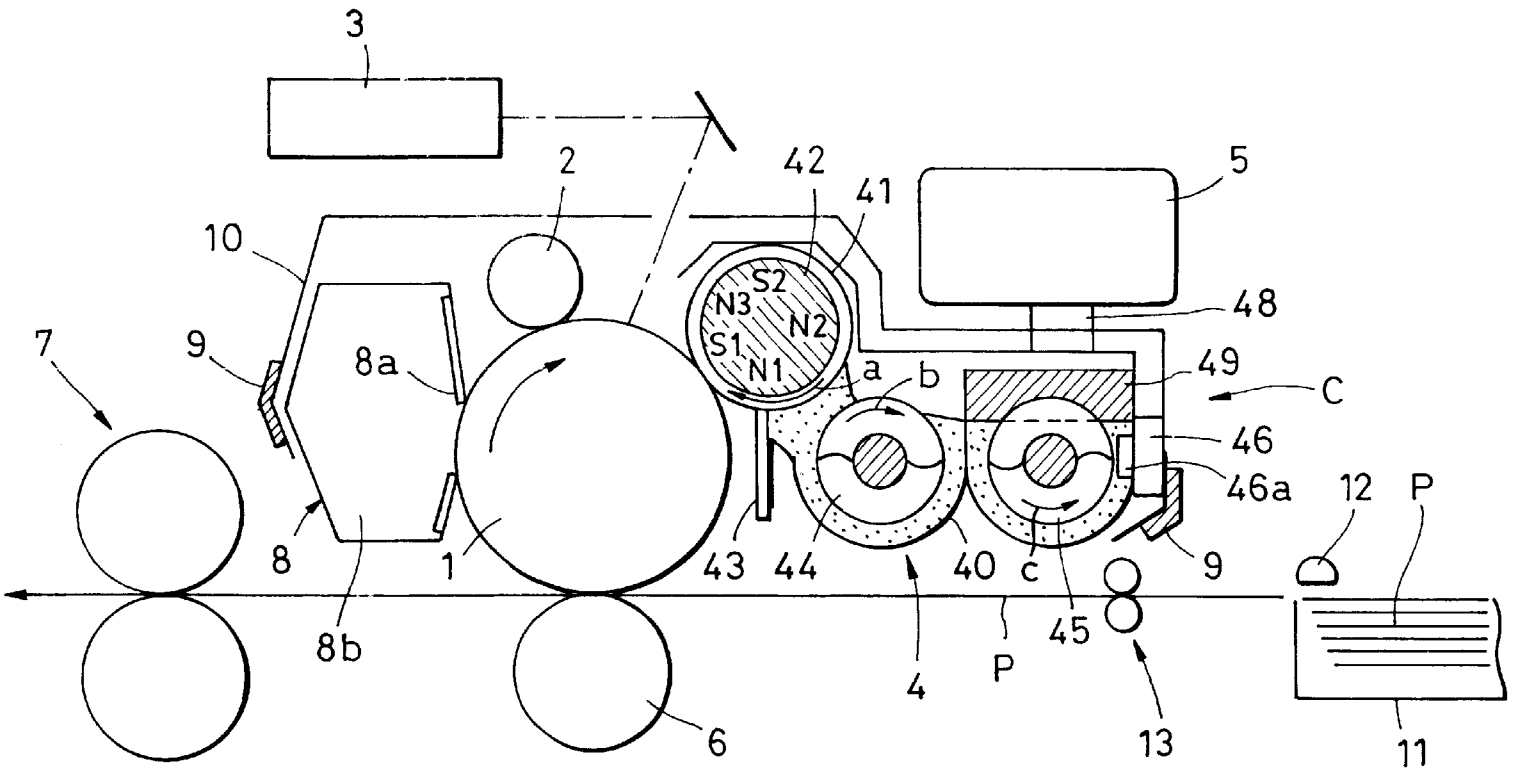
FIG. 1 is a schematic view showing one embodiment of an electrophotographic image forming apparatus to which a process cartridge according to the present invention is mounted in a detachable manner.

FIG. 1 schematically shows the construction of one embodiment of an image forming apparatus using a developing device according to the present invention. In this embodiment, the image forming apparatus is described as an electrophotographic image forming apparatus in which an image is formed on a recording medium by utilizing the electrophotographic image forming process, but the present invention is not limited to the embodiment described herein. It is to be understood that the present invention is also applicable to any type of image forming apparatus wherein a latent image is formed on an image carrier with the electrophotographic process or the electrostatic recording process, for example, and then developed using a two-component developer.

The electrophotographic image forming apparatus shown in FIG. 1 includes a cylindrical electrophotographic photoconductor, i.e., a photoconductive drum 1, which serves as an image carrier. An electrostatic image is formed on the photoconductive drum 1 by a latent image forming means. More specifically, a surface of the photoconductive drum 1 is charged with a predetermined potential by a charging roller 2 serving as a charging device. Thereafter, an exposure means 3 exposes the surface of the photoconductive drun 1 in accordance with image information to form an electrostatic latent image on the photoconductive drum 1. The electrostatic latent image formed on the photoconductive drum 1 is then visualized into a so-called toner image by a developing device 4. The toner image formed on the photoconductive drum 1 is transferred to a recording medium P under action of a transfer roller 6 serving as a transfer means. The recording medium P is fed at a predetermined timing to a transfer station, in which the photoconductive drum 1 and the transfer roller 6 are closely opposed to each other, by a paper feed means (recording medium feed means) that includes a paper supply cassette 11, a paper feed roller 12, a register roller pair 13. The recording medium P is then fed to a fusing device 7 where the not-yet-fused toner image on the recording medium is fused under heat and pressure for permanent fixation. After that, the recording medium is ejected out of the image forming apparatus.

On the other hand, the toner remaining on the photoconductive drum 1 after the transfer step is removed by a cleaning device 8 which comprises a cleaning blade 8*a* and a waste toner container 8*b*. The photoconductive drum 1 thus cleaned is subjected to a next cycle of the above-described image forming operation in a like manner.

A toner resupply unit 5 for replenishing toner to the developing device 4 is provided adjacent to the developing device 4. Though described in detail later, the toner resupply unit 5 communicates with the developing device 4 through a toner resupply port 48 formed in a developer container 40 of the developing device 4, and replenishes a toner to the developer container 40 through a predetermined operation.

In this embodiment, the photoconductive drum 1, the charging roller 2, the developing device 4, and the cleaning device 8, the latter three serving as process means acting upon the photoconductive drum 1, are constructed into an integral unit supported on a frame 10, i.e., as a process cartridge C, which is detachably mounted to a body of the image forming apparatus with fitting means 9 provided on the body of the image forming apparatus.

Figure 2:
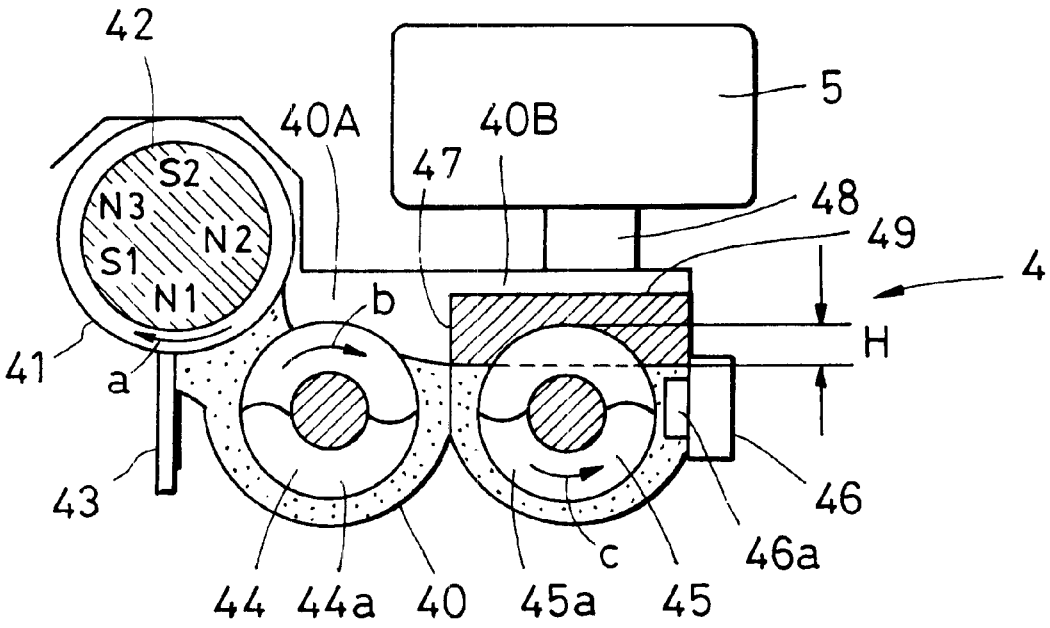
FIG. 2 is a schematic sectional view of one embodiment of a developing device according to the present invention.

FIG. 2 schematically shows the construction of the developing device 4 of this embodiment. In this embodiment, the developing device 4 is constructed as a two-component contact developing device (two-component magnetic brush developing device). More specifically, the developing device 4 contains a two-component developer, which is made up of magnetic particles (called a carrier) and a nonmagnetic toner (called a toner), in the developer container 40 serving as a developer containing portion. A developing sleeve 41 serving as a developer carrier and being rotatable in the direction of arrow "a" in FIG. 1 is disposed in an opening of the developer container 40 positioned to face the photoconductive drum 1. The developing sleeve 41 includes a stationary magnet roller 42 that serves as a magnetic field generating means. The stationary magnet roller 42 generates magnetic forces for retaining the carrier bearing the toner. Also, a doctor blade 43, serving as a developer layer thickness restricting means, is provided in an opposing relationship to the developing sleeve 41 with a predetermined gap between them. As the developing sleeve 41 rotates in the direction of arrow "a", the doctor blade 43 restricts a layer thickness of the developer supplied to the developing sleeve 41, thereby forming a thin layer of the developer.

The developing sleeve 41 is arranged to provide a predetermined gap with respect to the photoconductive drum 1, and the gap is set such that the thin layer of the developer formed on the developing sleeve 41 is in contact with the photoconductive drum 1. As the developing sleeve 41 rotates, the toner is transferred from the developer, which has been transported to the gap between the photoconductive drum 1 and the developing sleeve 41, to the electrostatic latent image on the photoconductive drum 1, thereby forming the toner image. Then, the developer is returned into the developer container 40 with rotation of the developing sleeve 41, and is mixed with the developer in the developer container 40 after being peeled off the developing sleeve 41 under repulsive forces between an N1 pole and an N2 pole, shown in FIG. 2, of the magnet roller 42. New developer is then sent to a developer layer thickness restricting portion defined by the doctor blade 43 and formed into a thin layer on the developing sleeve 41 for development.

In this embodiment, the developing sleeve 41 is an aluminum-made sleeve having an outer diameter of 16 mm. To achieve satisfactory transport of the developer, an appropriate roughness is preferably formed on a surface of the developing sleeve 41. In this embodiment, the roughness is formed by blasting the sleeve surface such that surface roughness is provided by Rz (JIS B 0601: 10-point average roughness)=approximately 5 to 10 $\mu$m. The photoconductive drum 1 is rotated at a circumferential speed of 100 mm/s, and the charged potential is set to −600 V in an unexposed area and −200 V in an exposed area. In the developing operation, a development bias in the form of a rectangular wave with a DC component of −400 V and an AC component of 1800 V is applied to the developing sleeve 41, whereupon the exposed area is subjected to reverse development.

Further, in this embodiment, a toner charged with negative electricity and having an average particle size (by weight) of 6 $\mu$m is used as the toner, and a magnetic carrier having saturation magnetization of 205 emu/cm$^3$ and an average particle size (by volume) of 35 $\mu$m is used as the carrier.

Within the developer container 40, an A screw 44 and a B screw 45 are provided respectively as first and second developer agitating and transporting means (agitating means). In this embodiment, as shown in FIG. 2, the A screw 44 having an outer diameter of 14 mm is arranged below the developing sleeve 41 in the vicinity thereof parallel with the longitudinal direction of the developing sleeve 41. As the A screw 44 rotates in the direction of arrow "b" in FIG. 2, it supplies the developer to the developing sleeve 41 and also transports the developer having been subjected to the development for return to the developer container 40. The B screw 45 having an outer diameter of 14 mm is arranged in an agitation chamber 40B partitioned by an inner wall 47 from a development chamber 40A on the opposite side in which the A screw 44 is arranged. As the B screw 45 rotates in the direction of arrow "c" in FIG. 2, it agitates a new toner replenished into the developing sleeve 41 and the carrier, thereby providing triboelectricity (electrical charges generated under friction) to the toner.

Figure 3:
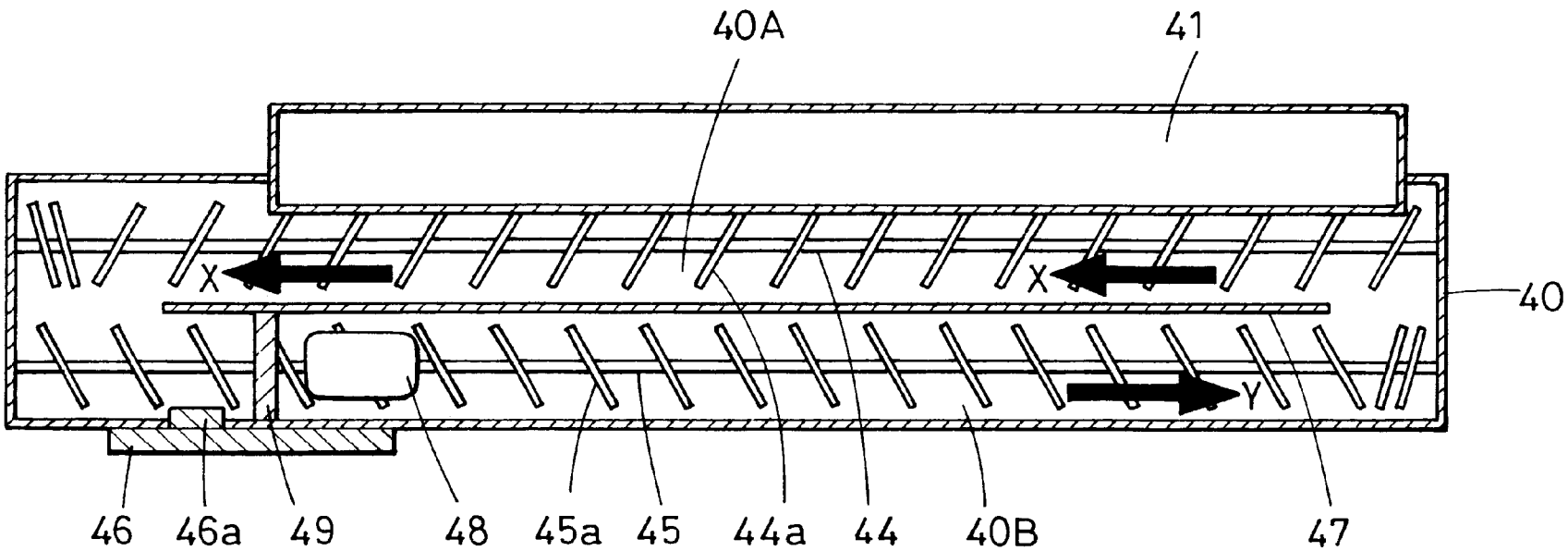
FIG. 3 is a schematic sectional view of the one embodiment of the developing device according to the present invention as viewed from above.

FIG. 3 schematically shows the construction of the developing device 4 of this embodiment as viewed from above. As will be understood from the drawings including FIG. 3, the A screw 44 and the B screw 45 are arranged substantially parallel with each other, and are rotated to transport the developer in the directions of respective arrows X and Y. Also, the inner wall 47 is provided between the A screw 44 and the B screw 45 to prevent the developer from moving directly from one of both the screws 44, 45 to the other. However, the inner wall 47 is not provided in the areas corresponding to longitudinal opposite portions of the A screw 44 and the B screw 45, allowing the developer to move between both the screws 44, 45. A circulation path for the developer is thereby formed within the developer container 40 to ensure continuous developer circulation.

Thus, with rotation of the A screw 44 and the B screw 45, the developer is circulated in the direction indicated by arrows "X" and "Y". In this embodiment, the amount of the developer transported through the developer container 40 is set to be substantially equal at one side (the development chamber 40A) of the developer container 40 in which the A screw 44 is disposed and the other side (the agitation chamber 40B) of the developer container 40 in which the B screw 45 is disposed, and upper surfaces of the developer (developer surfaces) in the development chamber 40A and the agitation chamber 40B are set to have substantially equal levels.

Also, a toner density sensor 46 serving as a developer amount detecting means is provided on a wall surface of the developer container 40 which faces the B screw 45 on the side opposite to the A screw 44. The toner density sensor 46 detects an apparent permeability change of the developer in a certain volume near the sensor by detecting the inductance of a coil, and determines a toner density (i.e., a mixing ratio of the carrier and the toner). Further, a sensor surface 46*a* of the toner density sensor (inductance sensor) 46 is positioned near the B screw 45 and arranged to lie perpendicularly to a line connecting a rotary shaft of the B screw 45 and the sensor surface 46*a*. The reason why the sensor surface 46*a* is so arranged with respect to the B screw 45 is in preventing buildup of the developer on the sensor surface 46*a*. If the toner is built up on the sensor surface 46*a*, the toner density sensor 46 will fail to precisely detect the toner density.

The toner resupply port 48 is disposed above the B screw 45 at a position slightly downstream of the toner density sensor 46 in the direction of transport of the developer. The developer container 40 communicates with the toner resupply unit 5 provided on the body of the image forming apparatus through the toner resupply port 48. The developer having been subjected to the development step and having a reduced toner density is sent to an area where the toner density sensor 46 is disposed, and its toner density is detected there. In accordance with a detected result of the toner density, an appropriate amount of the toner is replenished from the toner resupply unit 5 through the toner resupply port 48 of the developer container 40. The newly replenished toner is transported by the B screw 45 in the direction of arrow Y for mixing with the carrier, and further transported to the vicinity of the developing sleeve 41 after being charged with appropriate triboelectricity. Then, the toner is borne on the developing sleeve 41 in the form of a thin layer and is subjected to development.

In the present invention, a developer flow restricting member 49 is provided in the developer container 40 so as to satisfy the above-described conditions, i.e., (1) the developer surface level in the development chamber 40A should be held high to some extent, (2) the developer surface level in the agitation chamber 40B should be lower than the top of the screw vane 45*a* of the B screw 45, (3) the developer surface level in the agitation chamber 40B should be higher than the sensor surface 46*a* of the toner density sensor 46, and (4) the developer surface levels in the development chamber 40A and the agitation chamber 40B should be substantially horizontal in the longitudinal direction. The developer flow restricting member 49 now will be described below in more detail.

In this embodiment, the developer flow restricting member 49 comprises a plate-like molded member formed by molding of polystyrene (PS). Materials of the developer flow restricting member 49 are not particularly limited. In the case of using an inductance sensor as the toner density sensor 46 according to this embodiment, however, the developer flow restricting member 49 is preferably made of neither magnetic nor electrically conductive resin material because it is positioned near the inductance sensor 46. Although polystyrene (PS) is used in this embodiment, other materials such as ABS, polycarbonate, and polyphenylene sulfide (PPS) are also suitably usable.

In this embodiment, as shown in FIG. 2, the developer flow restricting member 49 is disposed above the B screw 45 to extend vertically so as to cover almost the upper half of the screw vane 45*a* of the B screw 45. Stated otherwise, the developer flow restricting member 49 is disposed such that its lower end portion with a predetermined height is positioned lower than the top of the screw vane 45*a* of the B screw 45.

Figure 4:
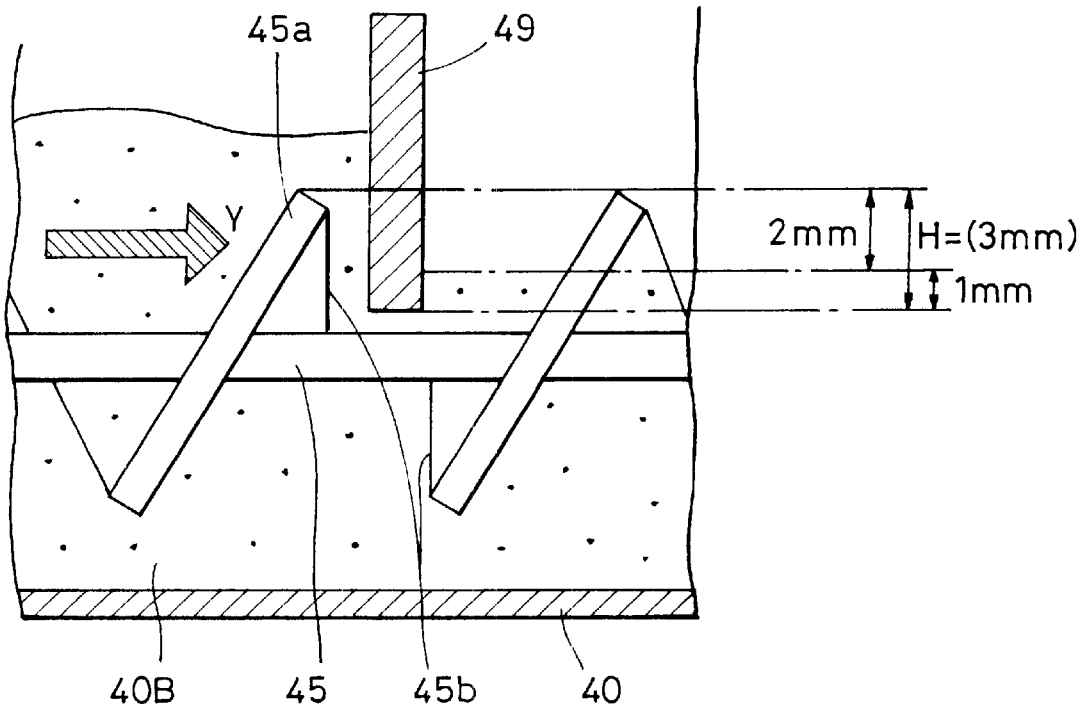
FIG. 4 is a detailed view of the vicinity of a developer flow restricting member.

More specifically, as will be understood from the drawings including FIG. 4, a distance H between the top of the screw vane 45*a* of the B screw 45 and the lower end of the developer flow restricting member 49 is set to 3 mm in this embodiment. Also, a vertical length of the developer flow restricting member 49 in a direction vertical to the axial direction of the B screw 45 is set to be substantially equal to the distance from the upper end of the inner wall 47 to the upper end of an inner wall surface of the developer container 40. Further, the developer flow restricting member 49 is disposed upstream of the toner resupply port 48 in the direction of transport of the developer. Moreover, the screw vane 45*a* of the B screw 45 extending in a spiral form is partly cut away at 45*b* to avoid interference with the developer flow restricting member 49.

Here, the amount of the developer accommodated in the developer container 40 is set such that the developer surface level in the agitating chamber 40B is achieved without provision of the developer flow restricting member 49 being lower than a predetermined level. In other words, the amount of the developer is set such that the developer surface level is not lower than an allowable lower limit even under conditions where the volume of the developer is reduced to a minimum in consideration of long-duration operation and environmental variations. In the developing device 4 of this embodiment, the bulk density of the developer is maximized (the weight of the developer per unit volume is maximized) under a high-temperature, high-humidity environment and in a later period of a long-duration operation. Accordingly, the amount of the developer is set such that the developer surface level in the agitation chamber 40B will not go below the allowable lower limit even under the above conditions.

In this embodiment, the allowable lower limit of the developer surface level in the agitation chamber 40B is given by a position 3 mm lower than the top of the B screw 45. If the developer surface level in the agitation chamber 40B is lower than such an allowable lower limit position, an unsatisfactory result would be caused because a detection level of the toner density sensor 46 varies.

Also, the developer surface level in the development chamber 40A would be too low if it is lower than the above allowable lower limit position. If so, the total amount of the developer transported from the A screw 44 to the developing sleeve 41 would be so small that the developer transported to the developing sleeve 41 is retained in a smaller amount in the developer layer thickness restricting portion defined by the doctor blade 43. As a result of a reduction in the amount of the developer retained in the developer layer thickness restricting portion, the supply of the developer from the A screw 44 to the developing sleeve 41 is more likely to vary. Accordingly, variations in the supply of the developer occur corresponding to the pitch of the screw vane 44*a* of the A screw 44, and a coating of the developer formed on the developing sleeve 41 is apt to have thicker and thinner portions, in which the amount of the developer is larger and smaller respectively, at the pitch of the screw vane 44*a*. This gives rise to an unsatisfactory result of causing the so-called screw pitch unevenness, i.e., unevenness in image density at the screw pitch.

In the developing device 4 of this embodiment, the amount of the developer given at the allowable lower limit position of the developer surface level, which is determined in consideration of a long-duration operation and environmental variations, was 170 g. Taking into account a slight margin from the allowable lower limit position, 180 g of the developer was accommodated in the developer container 40 in this embodiment.

Next, the following experiments were made to confirm the effect obtained from the provision of the developer flow restricting member 49. The developing device 4 of this embodiment including the developer flow restricting member 49 was mounted to the body of the image forming apparatus. On the other hand, as Comparative Examples, developing devices not including the developer flow restricting member 49 and accommodating the developer in different amounts of 160 g, 170 g and 180 g (Comparative Example 1 to Comparative Example 3 respectively) were each mounted to the body of the image forming apparatus. By using each of the image forming apparatuses thus constructed, the printing operation was carried out on 10,000 sheets of A4-size recording media with an image of 5% printing rate under high-temperature, high-humidity environment (32° C./85% RH) and low-temperature, low-humidity environment (15° C./10% RH).

Results of the experiments are listed below in Table 1.

TABLE 1

| | Amount of | High-temperature, High-humidity (32° C./85 %RH) | | Low-temperature, Low-humidity (15° C./10 %RH) | |
|---|---|---|---|---|---|
| | developer | unevenness | fogging | unevenness | fogging |
| Embodiment | 180 g | ○ | ○ | ○ | ○ |
| Com. Ex. 1 | 160 g | x | ○ | ○ | ○ |
| Com. Ex. 2 | 170 g | ○ | ○ | ○ | x |
| Com. Ex. 3 | 180 g | ○ | x | ○ | x |

As seen from Table 1, with the image forming apparatus including the developing device 4 of this embodiment, a satisfactory image was obtained without unevenness in image density and fogging under both the high-temperature, high-humidity environment and the low-temperature, low-humidity environment until the end of the long-duration operation. However, the problems of unevenness in image density and fogging occurred in Comparative Examples not including the developer flow restricting member 49.

In Comparative Example 1 having the amount of the developer set to 160 g, the screw pitch unevenness occurred under the high-temperature, high-humidity environment.

In Comparative Example 2 having the amount of the developer set to 170 g, the developer surface level was higher than the allowable lower limit position even under the high-temperature, high-humidity environment until the end of the long-duration operation, and therefore the problem of unevenness in image density did not occur even under the high-temperature, high-humidity environment in which the bulk density of the developer is increased. Under the low-temperature, low-humidity environment in which the developer surface level is increased, however, the problem of fogging occurred due to the developer surface level becoming too high. More specifically, the developer surface level was positioned above the top of the B screw 45, and a new toner replenished so as to be above the developer surface was not sufficiently mixed in the developer. The toner not yet satisfactorily charged with electricity was transferred to the developing sleeve 41, thus resulting in fogging.

In Comparative Example 3 having the amount of the developer set to 180 g, the developer surface level was too high under both the high-temperature, high-humidity environment and the low-temperature, low-humidity environment. Therefore, fogging occurred in both conditions.

By contrast, with the developing device of this embodiment including the developer flow restricting member 49, the developer surface level in the agitation chamber 40B was restricted to a level 2 mm lower than the top of the B screw 45, and very good results were obtained. More specifically, as mentioned above, the developer flow restricting member 49 was disposed such that its lower end vertically extends down 3 mm beyond the top of the B screw 45. However, the actual surface level of the developer having passed the developer flow restricting member 49 was raised 1 mm from the lower end of the member 49 and was controlled to a position 2 mm lower than the top of the B screw 45.

With the provision of the developer flow restricting member 49, even when the volume of the developer varies in practical use depending on environmental changes, the developer surface level is moved up and down upstream of the developer flow restricting member 49 in the direction of transport of the developer, as shown in FIG. 4, thereby absorbing volume variations of the developer. As a result, the developer surface level downstream of the developer flow restricting member 49 is kept constant.

Also, regarding the toner density detection effected by the toner density sensor 46, there is a problem that variations of an output value would occur if the developer surface varies at a level at or near the upper end of the sensor surface 46*a* of the toner density sensor 46. In this embodiment, since the toner density sensor 46 is disposed upstream of the developer flow restricting member 49, the developer surface varies at a relatively high level in the vicinity of the sensor surface 46*a*. Even when the developer surface varies at a level away from upward of the sensor surface 46*a*, the sensor output will hardly fluctuate and the toner density can be detected with stability.

Thus, by providing the developer flow restricting member 49, a portion of the agitation chamber 40B upstream of the developer flow restricting member 49 in the direction of transport of the developer is caused to function as an area for buffering volume variations of the developer to stabilize the developer surface level. If the buffer area (i.e., the area in which the developer surface level is relatively high) is present within a range of the developing sleeve 41 in the longitudinal direction thereof, there would be a risk of causing unevenness in image density.

Accordingly, it is not desired to produce the buffer area within the longitudinal range of the developing sleeve 41. Thus, an attempt of increasing a margin of the developer amount with respect to environmental variations and a long-duration operation can be realized by increasing the distance from the longitudinal downstream end of the developing sleeve 41 in the direction of transport of the developer to the developer flow restricting member 49 to enlarge the chamber volume upstream of the buffer area.

As described above, even when the bulk density of the developer varies depending on environmental variations and long-duration operation, this embodiment can satisfy the following conditions, i.e., (1) the developer surface level in the development chamber 40A should be held high to some extent, (2) the developer surface level in the agitation chamber 40B should be lower than the top of the screw vane 45*a* of the B screw 45, (3) the developer surface level in the agitation chamber 40B should be higher than the sensor surface 46*a* of the toner density sensor 46, and (4) the developer surface levels in the development chamber 40A and the agitation chamber 40B should be substantially horizontal in the longitudinal direction. As a result, the developer surface can be always kept at a level with stability, which is appropriate to surely prevent the occurrence of image failures such as unevenness in image density and fogging.

Second Embodiment

An image forming apparatus of second embodiment is basically the same as that of first embodiment. Therefore, components in second embodiment having the identical function and construction to those in first embodiment are denoted by the same symbols and a detailed description thereof is omitted here.

Figure 5:
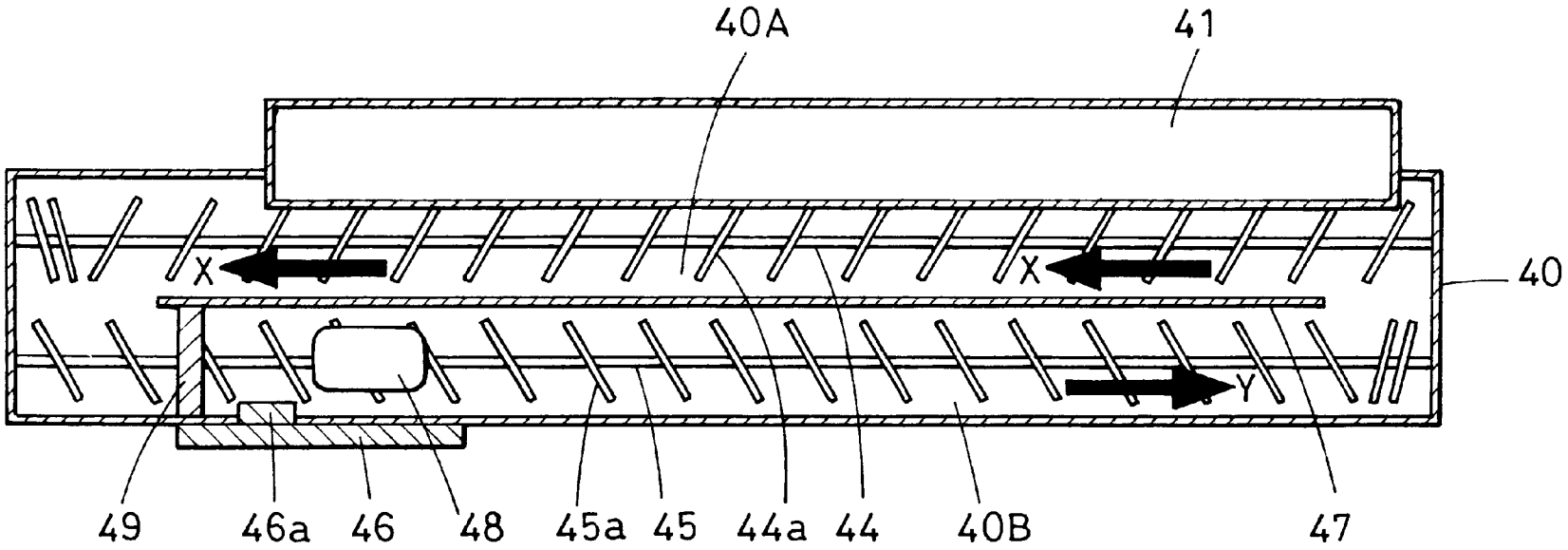
FIG. 5 is a schematic sectional view of another embodiment of the developing device according to the present invention as viewed from above.

FIG. 5 schematically shows the construction of the developing device of this embodiment as viewed from above. In the above-described first embodiment, the developer flow restricting member 49 is provided downstream of the toner density sensor 46 in the direction of transport of the developer. In this second embodiment, a developer flow restricting member 49 is provided upstream of a toner density sensor 46 in the direction of transport of the developer. The developer flow restricting member 49 is the same as that used in above first embodiment.

By providing the developer flow restricting member 49 upstream of the toner density sensor 46 in the direction of transport of the developer, this second embodiment enables the toner density sensor 46 to be arranged in an area where the developer surface level is stabilized by the developer flow restricting member 49.

With such an arrangement, the developer surface level near the sensor surface 46*a* of the toner density sensor 46 can be held constant so as not to vary depending on environmental variations and long-duration operations.

As a result, it is possible to completely prevent changes of the sensor output depending on variations of the developer surface level near the sensor surface 46*a* of the toner density sensor 46, and to perform toner density control in a stabilized manner.

With this second embodiment, the developer surface can also be maintained at a level with stability, which is appropriate to surely prevent the occurrence of image failures such as unevenness in image density and fogging, without being affected by variations in bulk density of the developer depending on environmental variations and a long-duration operation.

Figure 6:
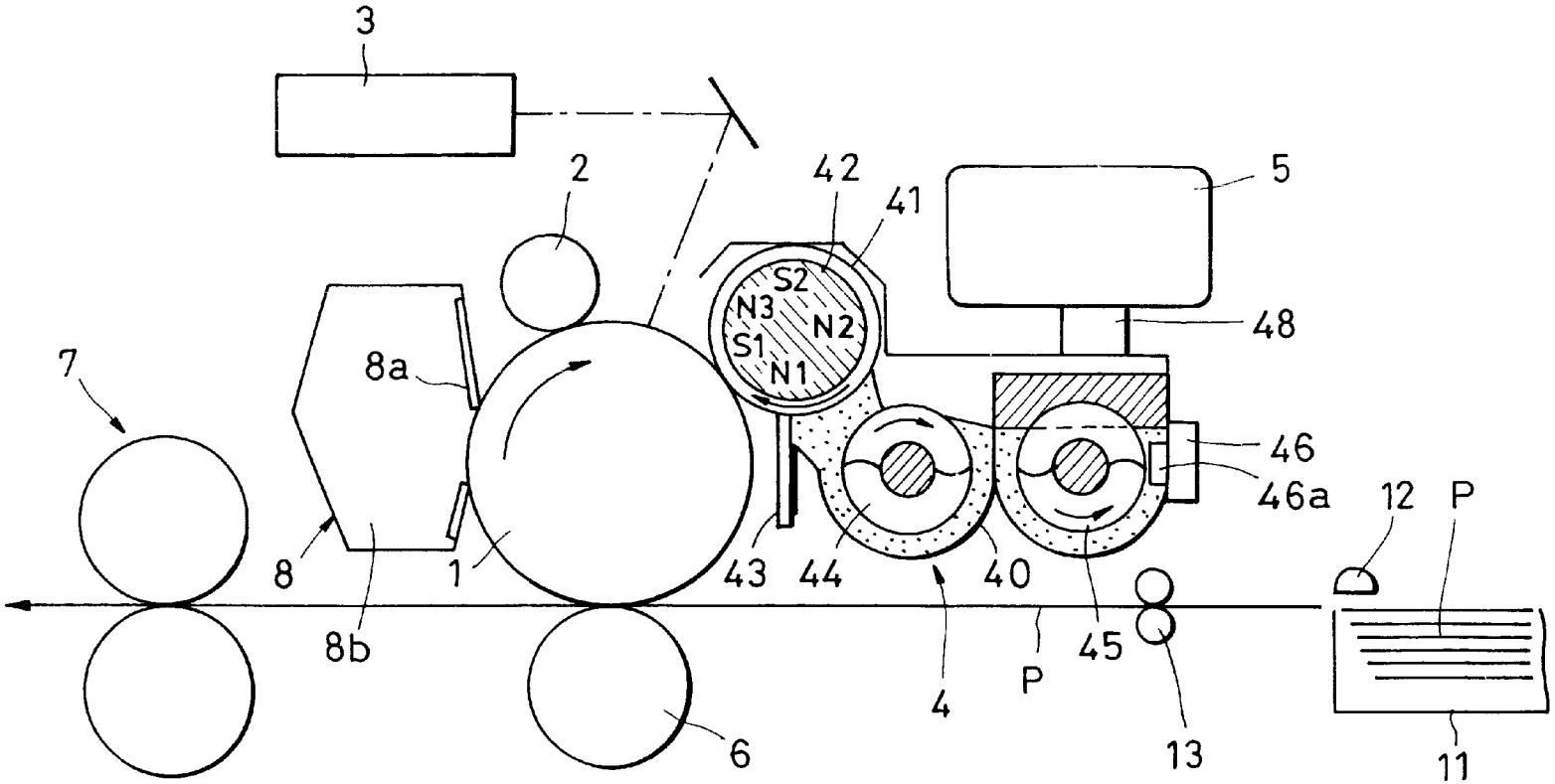
FIG. 6 is a schematic view showing another embodiment of the image forming apparatus according to the present invention.
Figure 7:
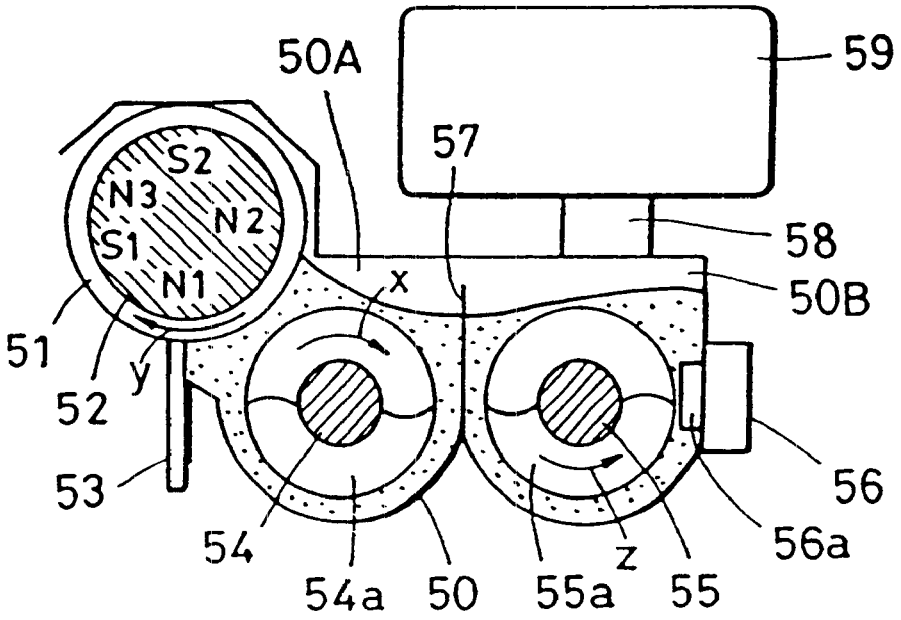
FIG. 7 PRIOR ART
FIG. 7 is a schematic sectional view showing one example of a conventional developing device.
Figure 8:
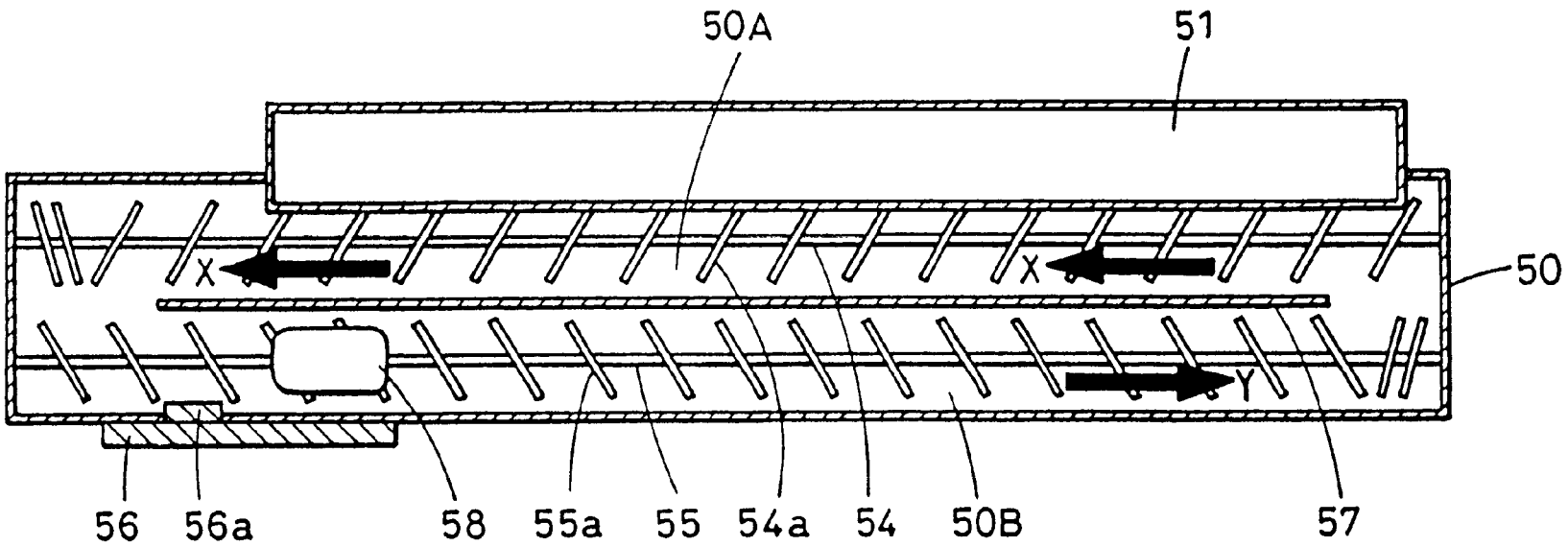
FIG. 8 PRIOR ART
FIG. 8 is a schematic sectional view of the one example of the conventional developing device as viewed from above.
Figure 9:
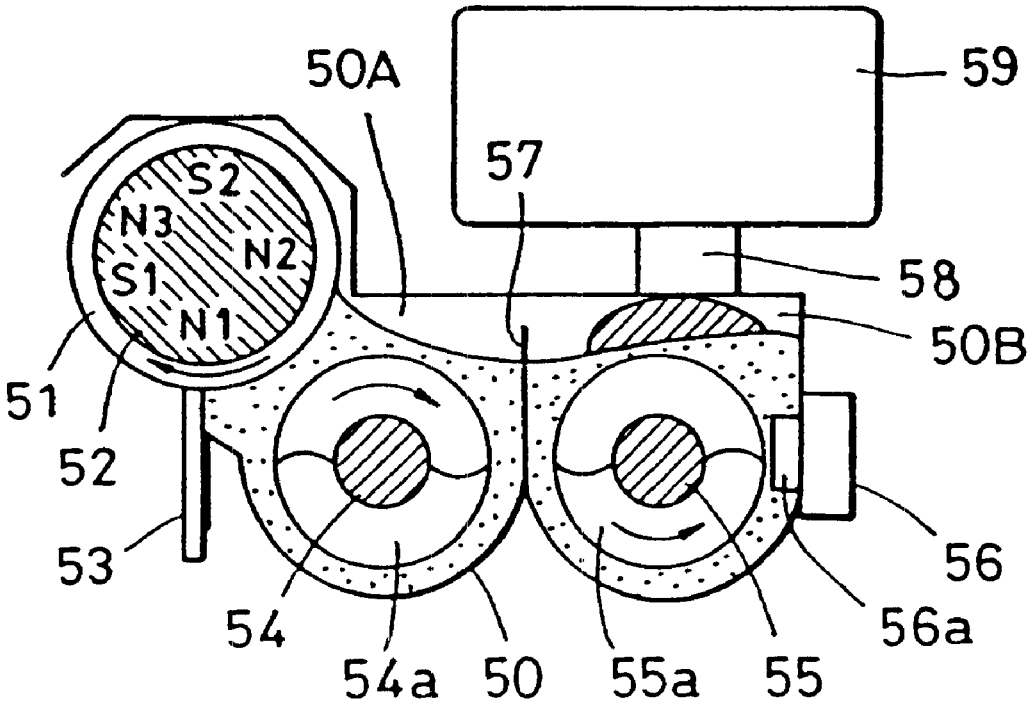
FIG. 9 PRIOR ART
FIG. 9 is a schematic sectional view of the conventional developing device for explaining a failure in agitation of a developer.

While in any of the above embodiments an image forming apparatus is described as an electrophotographic image forming apparatus of a process cartridge type, the present invention is not limited to that type of image forming apparatus. For example, as shown in FIG. 6, the present invention is also of course applicable to an image forming apparatus wherein a developing device is fixed to a body of the image forming apparatus and a toner is replenished to the developing device from a toner resupply unit. In FIG., components having the identical function and construction to those of the image forming apparatus shown in FIG. 1 are denoted by the same reference characters and numerals.

It is to be understood that the present invention can be further applied to an image forming apparatus wherein a developing device is constructed into a cartridge which is detachably mounted to a body of the image forming apparatus with fitting means provided on the apparatus body. In the image forming apparatus shown in FIG. 1, the photoconductive drum 1, the charging device 2, the developing device 4 and the cleaning device 8 are constructed integrally into the process cartridge C, which is detachably mounted to the body of the image forming apparatus with the fitting means 9. By contrast, in the above case, only the developing device 4 is detachably mounted to the body of the image forming apparatus with similar fitting means.

The image forming apparatus, the process cartridge and the electrophotographic image forming apparatus of the embodiments, as described above, each comprises a developer container for containing a two-component developer made up of magnetic particles and a toner, developer agitating and transporting means for transporting the developer in the developer container while agitating the developer, and a toner resupply port disposed above the developer agitating and transporting means. Then, an upper surface of the developer contained in the developer container is restricted upstream of the toner resupply port in the direction in which the developer is transported by the developer agitating and transporting means. Therefore, a position of the upper surface of the developer (developer surface) contained in the developer container can be held at an appropriate level, and image failures such as unevenness in image density and fogging can be prevented to always provide a high-quality image. Further, according to the embodiments, even when the bulk density of the developer contained in the developer container varies depending on environmental variations and a long-duration operation, the developer surface can be maintained at a level with stability, which is appropriate to surely prevent the occurrence of image failures such as unevenness in image density and fogging.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developing device comprising:

a developer container for containing a developer made up of magnetic particles and a toner;

a developer carrier for bearing and transporting the developer;

first agitating and transporting means provided in said developer container, said first agitating and transporting means transporting the developer while agitating the developer;

second agitating and transporting means provided in said developer container, said second agitating and transporting means transporting the developer transported by said first agitating and transporting means while agitating the developer thereby supplying the developer to said developer carrier; and a restricting member provided in said developer container, said restricting member restricting passage of an upper portion of the developer transported by said first agitating and transporting means, wherein said restricting member is adapted to restrict the upper portion of the developer such that an upper surface level of the developer downstream of said restricting member is a predetermined amount lower than an uppermost end of said first agitating and transporting means.

2. A developing device according to claim 1, wherein said restricting member is provided adjacent to an upstream end portion of said first agitating and transporting means in a direction in which the developer is transported by said first agitating and transporting means.

3. A developing device according to claim 1, wherein a toner resupply port is disposed above said first agitating and transporting means, and said restricting member is provided upstream of said toner resupply port in a direction in which the developer is transported by said first agitating and transporting means.

4. A developing device according to claim 3, further comprising density detecting means for detecting a toner density in the developer, said density detecting means being provided upstream of said toner resupply port in the direction in which the developer is transported by said first agitating and transporting means.

5. A developing device according to claim 4, wherein said restricting member is provided downstream of said density detecting means in the direction in which the developer is transported by said first agitating and transporting means.

6. A developing device according to claim 4, wherein said restricting member is provided upstream of said density detecting means in the direction in which the developer is transported by said first agitating and transporting means.

7. A developing device according to claim 1, wherein said restricting member restricts the upper portion of the developer such that an upper surface level of the developer downstream of said restricting member in a direction, in which the developer is transported by said first agitating and transporting means, is a predetermined amount lower than an uppermost end of said first agitating and transporting means.

8. A developing device according to claim 1, wherein said first and second agitating and transporting means each comprises a rotary shaft and a spiral screw vane provided around said rotary shaft.

9. A developing device according to claim 1, wherein said developing device is detachably mounted to a body of an image forming apparatus in which an electrostatic latent image formed on an image carrier is developed using a developer to form an image on a recording medium.

10. A developing device according to claim 1, wherein said developing device is constructed as a process cartridge together with an image carrier for bearing a latent image thereon, said cartridge being detachably attached to a body of an image forming apparatus.

11. A developing device according to claim 1, wherein said restricting member comprises a plate-like member.

12. A developing device according to claim 1, wherein said restricting member is made of a nonmagnetic material.

13. A developing device according to claim 1, wherein said restricting member is formed by molding any one of polystyrene ABS, polycarbonate, and polyphenylene sulphide.

14. An image forming apparatus comprising:

an image carrier for bearing a latent image thereon; and a developing device for developing the latent image, said developing device comprising:

a developer container for containing a developer made up of magnetic particles and a toner;

a developer carrier for bearing and transporting the developer;

first agitating and transporting means provided in said developer container, said first agitating and transporting means transporting the developer while agitating the developer;

second agitating and transporting means provided in said developer container, said second agitating and transporting means transporting the developer transported by said first agitating and transporting means while agitating the developer, thereby supplying the developer to said developer carrier; and a restricting member provided in said developer container, said restricting member restricting passage of an upper portion of the developer transported by said first agitating and transporting means, wherein said restricting member restricts the upper portion of the developer such that an upper surface level of the developer downstream of said restricting member is a predetermined amount lower than an uppermost end of said first agitating and transporting means.

15. An image forming apparatus according to claim 14, wherein said restricting member is provided on an upstream side in a direction in which the developer is transported by said first agitating and transporting means.

16. An image forming apparatus according to claim 14, wherein a toner resupply port is disposed above said first agitating and transporting means, and said restricting member is provided upstream of said toner resupply port in a direction in which the developer is transported by said first agitating and transporting means.

17. An image forming apparatus according to claim 16, further comprising density detecting means for detecting a toner density in the developer, said density detecting means being provided upstream of said toner resupply port in the direction in which the developer is transported by said first agitating and transporting means.

18. An image forming apparatus according to claim 17, wherein said restricting member is provided downstream of said density detecting means in the direction in which the developer is transported by said first agitating and transporting means.

19. An image forming apparatus according to claim 18, wherein said restricting member is providing upstream of said density detecting means in the direction in which the developer is transported by said first agitating and transporting means.

20. An image forming apparatus according to claim 14, wherein said restricting member restricts the upper portion of the developer such that an upper surface level of the developer downstream of said restricting member in a direction, in which the developer is transported by said first agitating and transporting means, is a predetermined amount lower than an uppermost end of said first agitating and transporting means.

21. An image forming apparatus according to claim 14, wherein said first and second agitating and transporting means each comprises a rotary shaft and a spiral screw vane provided around said rotary shaft.

22. An image forming apparatus according to claim 14, wherein said developing device is detachably mounted to a body of an image forming apparatus in which an electrostatic latent image formed on an image carrier is developed using a developer to form an image on a recording medium.

23. An image forming apparatus according to claim 14, wherein said developing device is constructed as a process cartridge together with said image carrier, said process cartridge being detachably attached to a body of said image forming apparatus.

24. An image forming apparatus according to claim 14, wherein said restricting member is a plate-like member.

25. An image forming apparatus according to claim 14, wherein said restricting member is made of a nonmagnetic material.

26. An image forming apparatus according to claim 14, wherein said restricting member is formed by molding any one of polystyrene ABS, polycarbonate, and polyphenylene sulphide.

27. A developing device comprising:

a developer container for containing a developer made up of magnetic particles and a toner;

a developer carrier for bearing and transporting the developer;

first agitating and transporting means provided in said developer container, said first agitating and transporting means transporting the developer while agitating the developer;

second agitating and transporting means provided in said developer container, said second agitating and transporting means transporting the developer transported by said first agitating and transporting means while agitating the developer thereby supplying the developer to said developer carrier; and a restricting member provided in said developer container, said restricting member restricting passage of an upper portion of the developer transported by said first agitating and transporting means, wherein said restricting member is adapted to restrict the upper portion of the developer such that an upper surface level of the developer downstream of said restricting member is a predetermined amount lower than an uppermost end of said first agitating and transporting means, and wherein a toner resupply port is disposed above said first agitating and transporting means, and said restricting member is provided upstream of said toner resupply port in a direction in which the developer is transported by said first agitating and transporting means.

28. A developing device according to claim 27, wherein said restricting member is provided adjacent to an upstream end portion of said first agitating and transporting means in a direction in which the developer is transported by said first agitating and transporting means.

29. A developing device according to claim 27, further comprising density detecting means for detecting a toner density in the developer, said density detecting means being provided upstream of said toner resupply port in the direction in which the developer is transported by said first agitating and transporting means.

30. A developing device according to claim 29, wherein said restricting member is provided downstream of said density detecting means in the direction in which the developer is transported by said first agitating and transporting means.

31. A developing device according to claim 29, wherein said restricting member is provided upstream of said density detecting means in the direction in which the developer is transported by said first agitating and transporting means.

32. A developing device according to claim 27, wherein said first and second agitating and transporting means each comprises a rotary shaft and a spiral screw vane provided around said rotary shaft.

33. A developing device according to claim 27, wherein said developing device is detachably mounted to a body of an image forming apparatus in which an electrostatic latent image formed on an image carrier is developed using a developer to form an image on a recording medium.

34. A developing device according to claim 27, wherein said developing device is constructed as a process cartridge together with an image carrier for bearing a latent image thereon, said cartridge being detachably attached to a body of an image forming apparatus.

35. A developing device according to claim 27, wherein said restricting member comprises a plate-like member.

36. A developing device according to claim 27, wherein said restricting member is made of a nonmagnetic material.

37. A developing device according to claim 27, wherein said restricting member is formed by molding any one of polystyrene ABS, polycarbonate, and polyphenylene sulphide.

* * * * *

UNITED STATES PATENT AND TRADEMARK OFFICE

CERTIFICATE OF CORRECTION

PATENT NO. : 6,421,516 B1 
DATED : July 16, 2002
INVENTOR(S) : Masahide Kinoshita et al.

It is certified that error appears in the above-identified patent and that said Letters Patent is hereby corrected as shown below:

Column 1,
Line 10, “a” should read -- an --.

Column 3,
Line 32, “a” should read -- A --.

Column 4,
Line 5, “dropped” should read -- decreased --; and
Line 65, “optimum” should read -- optimally --.

Column 6,
Line 45, “drun” should read -- drum --.

Column 12,
Lines 37 and 38, “density. ¶Accordingly,” should read -- density. Accordingly, --.

Column 13,
Line 45, “FIG.,” should read -- FIG. 6, --.

Signed and Sealed this

Fourteenth Day of January, 2003

JAMES E. ROGAN
*Director of the United States Patent and Trademark Office*